US005464072A

United States Patent [19]

Müller

[11] Patent Number: 5,464,072

[45] Date of Patent: Nov. 7, 1995

[54] SELF-PROPELLED ELEVATOR SYSTEM

[75] Inventor: Wolfgang Müller, Meggen, Switzerland

[73] Assignee: Inventio AG, Hergiswil NW, Switzerland

[21] Appl. No.: 143,490

[22] Filed: Oct. 27, 1993

[30] Foreign Application Priority Data

Oct. 27, 1992 [CH] Switzerland ..... 03340/92

[51] Int. Cl.[6] ..... B66B 9/00

[52] U.S. Cl. ..... 187/249; 187/410; 182/12

[58] Field of Search ..... 187/17, 16, 95, 187/19, 22, 26, 1 R, 250, 249, 410; 182/12, 13, 14

[56] References Cited

U.S. PATENT DOCUMENTS

| | | | |
|---|---|---|---|
| 2,052,690 | 9/1936 | Austin | 187/16 |
| 5,090,515 | 2/1992 | Takahashi et al. | 187/16 |

FOREIGN PATENT DOCUMENTS

| | | |
|---|---|---|
| 0330809 | 9/1989 | European Pat. Off. . |
| 0388814 | 9/1990 | European Pat. Off. . |
| 1251925 | 10/1967 | Germany . |
| 6932326 | 8/1969 | Germany . |
| 0318516 | 10/1991 | Japan . |
| 406565 | 1/1966 | Switzerland . |

*Primary Examiner*—Kenneth Noland
*Attorney, Agent, or Firm*—Howard & Howard

[57] ABSTRACT

A self-propelled elevator car for vertical and horizontal travel in an elevator shaft has a plurality of driven friction wheels which are pressed against associated running surfaces by a passive contact force which produces the necessary friction and is influenced by a load-dependent gravitational force and an additional regulated active force. The friction wheels are rotatably mounted at free ends of guide arms having opposite ends pivotally connected to a lifting carriage attached to the bottom of the car. The guide arms extend downwardly and outwardly at a defined angle to the horizontal of a straight line between the pivot point and a contact point of the friction wheels with the running surface such that the gravitational force acting on the car forces the wheels outwardly. The active force can be applied by setting elements connected between the carriage and the guide arms. A force sensor mounted at the pivot point senses the passive force and is connected to a processor control which controls the active force applied by the setting elements in accordance with the value of the passive force.

19 Claims, 3 Drawing Sheets

SELF-PROPELLED ELEVATOR SYSTEM

BACKGROUND OF THE INVENTION

The present invention relates generally to an apparatus for transporting passengers and, in particular, to a self-propelled elevator system.

The German patent specification No. 1 25 1 925 shows an elevator with a friction wheel drive having friction and guide wheels running in the comers of the elevator shaft. The driven friction wheels, each with separate drive motor, are positioned on the top of the elevator car diagonally opposite one another and are pressed against the running bed or track by way of a pivot support and tightening screw.

German Utility Model specification No. G 69 32 326.8 shows a "column elevator" in which a friction wheel drive provided with two pneumatic tires is attached to the elevator car. A T-shaped cross section rail or column has a base flange attached at the center of a rear side of a cross flange. The tires run on the opposite side of the cross flange and necessary contact pressure for sufficient friction is achieved by suspending the car directly from the drive and utilizing counter rollers which are mounted higher than the tires and run on the rear side of the cross flange. The contact pressure is varied by changing the connecting lever ratio and by the car weight. In the case of the latter, the car itself is used as a lever and counterweight. Therefore, the car will not always be in an exactly vertical position and during travel along the rail is prone to vibration due to the resilient pneumatic tires causing rotary oscillations about the fulcrum lying between counter roller and pneumatic tire.

The present invention is based on the task of overcoming the problems associated with the known drives by creating a friction wheel drive which is suitable for comfortable transport of persons, works mechanically independently of the car, always has sufficient friction, needs no counter rollers, needs no carrier and counterbalancing elements, makes possible a rational modular manner of construction and which is suitable not only for vertical travel, but also for horizontal travel. Furthermore, the friction between the wheels and the track surface shall be controllable for all situations.

SUMMARY OF THE INVENTION

The present invention concerns a self-propelled transport system, such as an elevator particularly for persons, including at least one car and a vertically acting friction wheel drive having friction wheels which project laterally beyond the sides of the car and are pressed in an approximately horizontal direction against an associated running surface on an elevator shaft guide groove or guide rail by a force applying device. Such systems enable the operation of several cars in the same shaft because no carrier elements and signal supply lines are present and because, in some cases, no guide rails are used. The force applying device includes a carriage attached to the elevator car which car generates a load-dependent passive gravitational force on the carriage; a plurality of guide arms each having one end pivotally attached to the carriage and extending downwardly and outwardly to an opposite free end, each opposite free end being connected to an associated friction wheel for applying the load-dependent passive gravitational force as a passive contact pressure pressing the associated friction wheel against a wall of the shaft; and a setting element connected between the carriage and at least one of the guide arms for applying an active contact pressure to the one guide arm pressing the associated friction wheel against the wall of the shaft. A force sensor can be mounted at the one end of the one guide arm for generating a pressure signal representing the passive contact pressure. A processor control has an input connected to the force sensor and an output connected to the setting element and is responsive to a predetermined value of the pressure signal for generating a control signal to the setting element for applying the active contact pressure.

The guide arms are positioned at a predetermined angle with respect to a horizontal direction transverse to the direction of travel of the car. A stay can be connected between the carriage and another one of the guide arms and a sleeve nut can be attached to the stay for adjusting the length of the stay. An adjustable compression spring can be connected between the one guide arm and another one of the guide arms by pushrods for forcing the guide arms toward the wall of the shaft.

Some of the advantages achieved by the present invention are that no engine room is required, that more than one car can travel in the same shaft, that the car can also move horizontally from one shaft to another shaft and that no carrier and counterbalancing elements are needed.

A further advantage is that by means of an on-board energy store horizontal travels can be executed independently of the mains supply and that in the case of vertical travel temporary interruptions in the energy supply to the elevator car can be bridged over as a safety measure.

BRIEF DESCRIPTION OF THE DRAWINGS

The above, as well as other advantages of the present invention, will become readily apparent to those skilled in the an from the following detailed description of a preferred embodiment when considered in the light of the accompanying drawings in which.

DESCRIPTION OF THE PREFERRED EMBODIMENT

Figure 1:
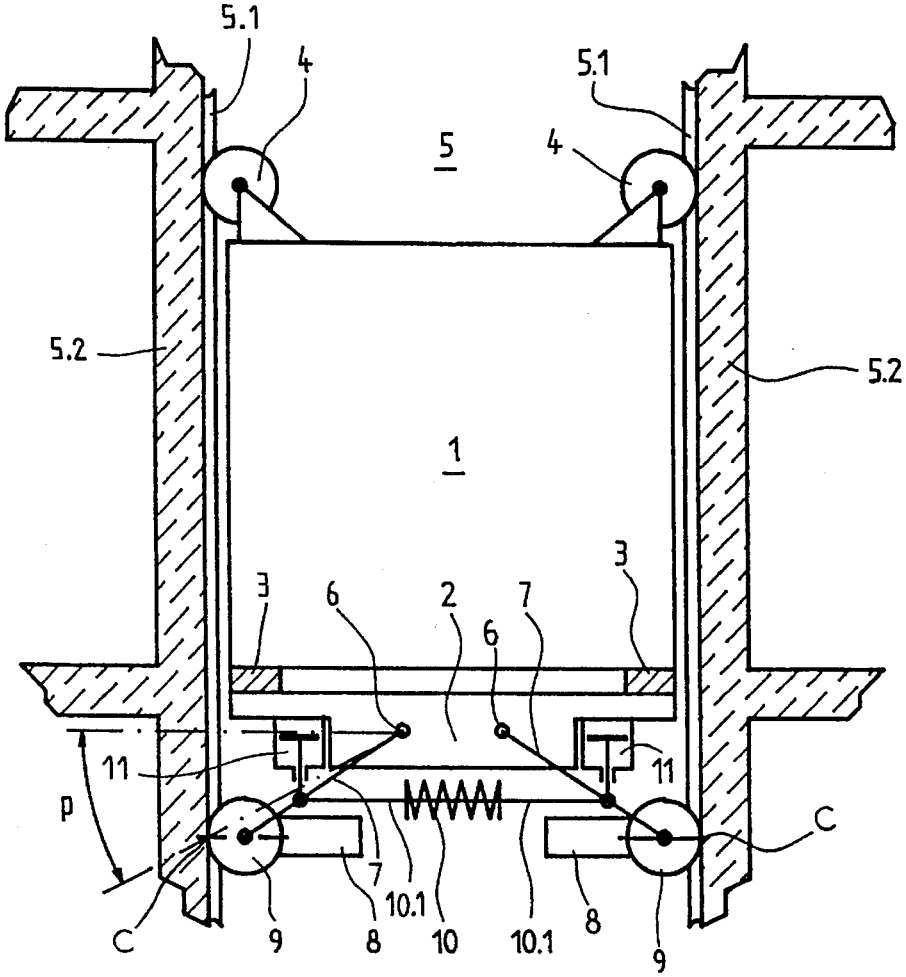
FIG. 1 is a front elevation view of a self-propelled friction wheel drive elevator car in accordance with the present invention.

There is shown in the FIG. 1 a self-propelled car 1 which is supported on a lifting carriage 2 by a plurality of vibration damping elements 3. Guide rollers 4 are mounted on the top of the car 1 at both sides thereof. The car 1 travels vertically in an elevator shaft 5 with the guide rollers 4 running in guide grooves 5.1 formed in opposite walls 5.2 of the shaft 5. Pivot points 6 located on the underside of the lifting carriage 2 pivotally mount one end of associated guide arms 7 which arms extend obliquely downwardly towards the shaft wall 5.2. The guide arms 7 each have opposite ends attached to an associated drive 8 and an associated friction wheel 9. The friction wheels 9 run in the adjacent guide grooves 5.2. A stationary adjustable compressor spring 10 is located below the lifting carriage 2 and extends horizontally on connecting rods 10.1. Free ends of the connecting rods 10.1 are each connected at about a midpoint of an adjacent one of the guide arms 7. A pair of setting elements 11 are fastened to the bottom of the lifting carriage 2 and are connected to associated ones of the guide arms 7 at the connection points for the connecting rods 10.1. The drive components shown in the FIG. 1 are duplicated on the opposite rear side of the car 1. The friction wheels 9 contact the running surface in the guide groove 5.1 at a contact point c. The angle of a straight line drawn between the pivot point 6 and the contact point c relative to the horizontal is denoted by p.

Figure 2:
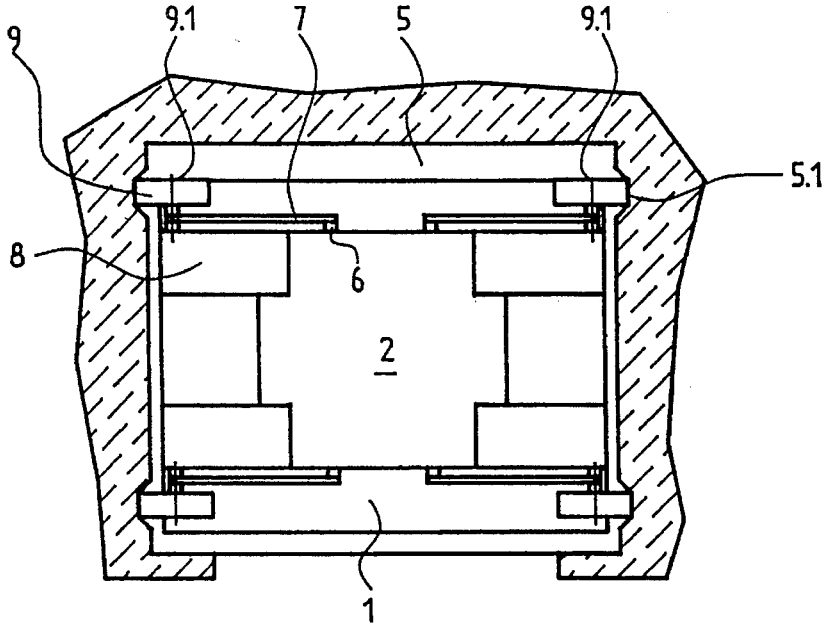
FIG. 2 is bottom plan view of the apparatus shown in the FIG. 1.

In the FIG. 2 there is shown a possible configuration of the guide grooves 5.1 as well as the friction wheel drives at both the front and rear of the carriage 2. The wheels 9 are each rotatably mounted on an associated axle 9.1 with the axles on opposite sides of the carriage being generally parallel to one another. The axles 9.1 are rotatably mounted at the free end of each associated guide arm 7.

Figure 3:
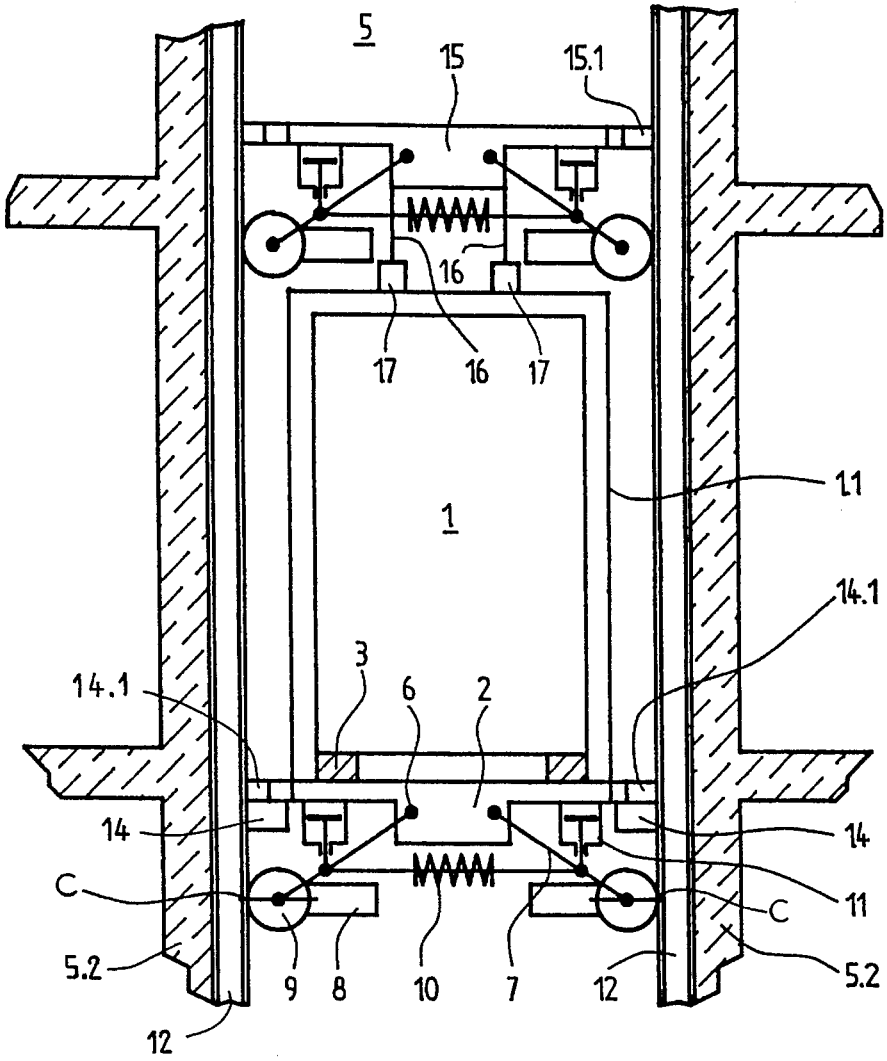
FIG. 3 is a front elevation view of a self-propelled friction wheel drive elevator car in accordance with another embodiment of the present invention.
Figure 4:
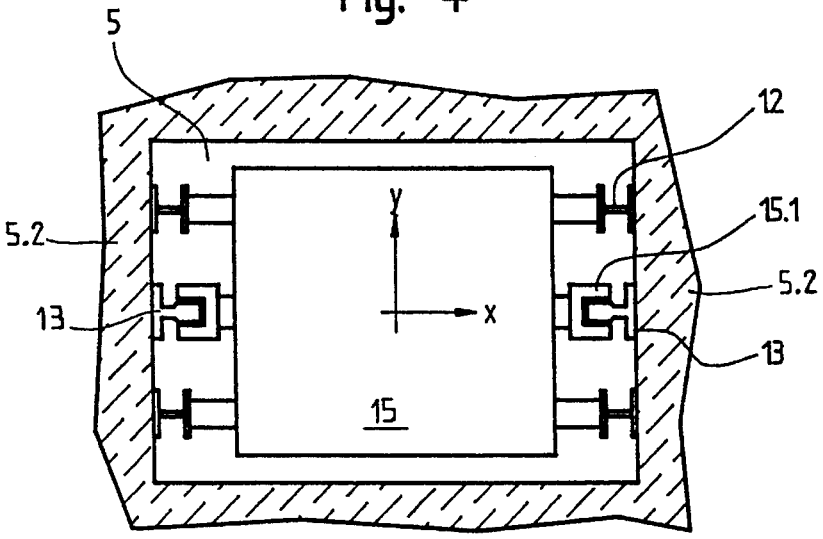
FIG. 4 is top plan view of the apparatus shown in the FIG. 3.

In the FIGS. 3 and 4, there is shown an alternate embodiment of the present invention in which the car 1 is positioned in a car frame 1.1. Located below and attached to the car frame 1.1 is the lifting carriage 2. A pair of double T-section or I-shaped track rails 12 are mounted on each of the opposed shaft walls 5.2 and the friction wheels 9 run on these rails. In addition, a T-section guide rail 13 is mounted on each of the opposed shaft walls 5.2 between the adjacent track rails 12. Also attached to the lifting carriage 2 is a safety device 14 and a guide element 14.1 at each side thereof. A pulling carriage 15 is attached to the top of the car frame 1.1 by tie rods 16 and suitable fasteners 17. The pulling carriage 15 is in principle constructed the same as the lifting carriage 2 and has a guide element 15.1 attached to both sides thereof. The guide elements 14.1 and 15.1 are aligned vertically and engage the guide rail 13 to effect a guidance of the car 1 in the Y direction as shown in the FIG. 4. The safety device 14 also acts on the T-section guide rail 13.

Figure 5:
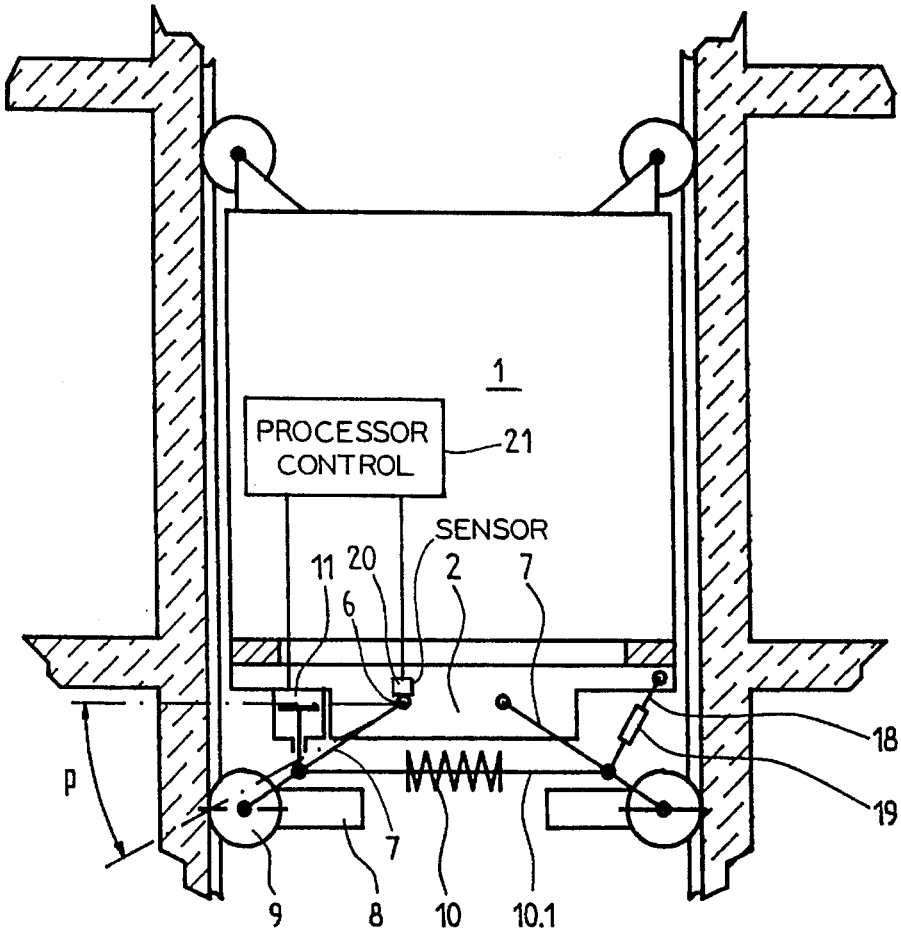
FIG. 5 is a front elevation view of a self-propelled friction wheel drive elevator car in accordance with a third embodiment of the present invention.

In the FIG. 5, there is shown a third embodiment of the present invention in which the guide arm 7 at the right side of the carriage 2 is rigidly held in a defined position by a stay 18 adjustable in length by an adjusting sleeve nut 19 coupled thereto. The stay 18 is connected between the carriage 2 and the arm 7 in place of the setting element 11 shown in the FIGS. 1 and 3.

Figure 6:
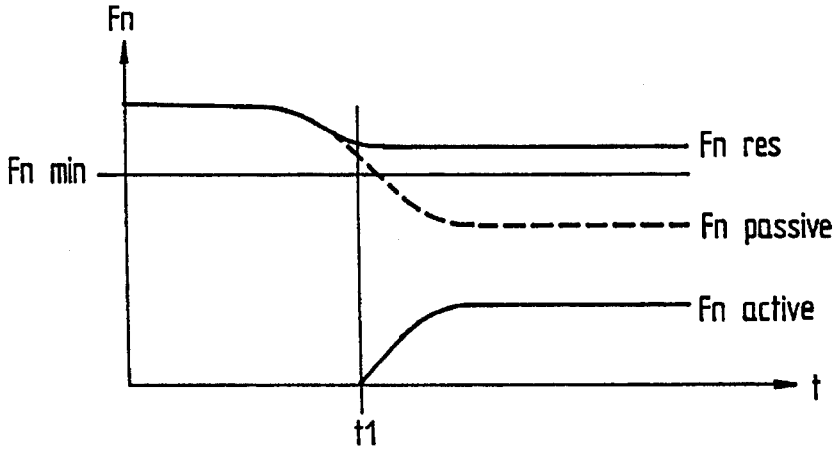
FIG. 6 is a graph of contact pressure versus time for the operation of the present invention.

The FIG. 6 is a force diagram in which the interaction of active and passive contact pressure is graphed as force Fn versus time t. In this diagram:

Fn=force or contact pressure;

Fn passive=present, passive contact pressure;

Fn min=the minimum necessary contact pressure;

Fn active=the active, additional contact pressure; and

Fn res=the resultant contact pressure from Fn active+Fn passive.

The present invention operates by taking into consideration the magnitudes of contact pressure Fn (normal force in the horizontal direction, perpendicular into the running surface), the coefficient of friction μ and the vertically downwardly acting gravitational force of the mass to be conveyed. The coefficient of friction μ is dependent on the composition of the contact surface for the friction wheel 9 and the running surface in the guide groove 5.1. This can, for example, be presumed to be 0.6 in the case of a smooth, clean concrete or steel surface in the guide groove 5.1 and with elastomer coated friction wheels 9. In the present invention, the pivoted guide arm 7 carrying the friction wheel 9 and drive 8 forms a force applying device in which a spreading effect occurs which effects a pressing of each of the friction wheels 9 in the horizontal direction against the running surface due to the gravitational force of the masses to be conveyed. It is further apparent that the magnitude of the spreading effect or the magnitude of the contact pressure Fn is dependent on the negative angle p of the straight line between the contact point c and the pivot point 6 relative to the horizontal. Calculations and measurements yield a practicable value for the angle p of, for example, 20°.

Because this spreading effect now arises without assistance of further force generating mechanisms, no additional energy has to be supplied, and the thereby arising contact pressure Fn is designated in the following description by Fn passive. The compression spring 10, connected horizontally between the guide arms 7 on the connecting rods 10.1, serves the purpose of compensating, through adjustable prestress, for the weights of the friction wheel drive systems and maintaining the contact of the friction wheels 9 with the running surface in the case of possible vibrations during the travel of the car 1. The contact pressure Fn passive is larger, depending on acceleration, by a dynamic component when starting the car 1 in the upward direction and, conversely, is correspondingly reduced when starting the car in the downward direction.

It is given by the influencing magnitudes of gravitational force of the masses to be conveyed and the angle p that the contact pressure Fn passive of the friction wheels 9 is automatically set to the necessary value. However, with respect to adequate safety it is desired to completely control the contact pressure. For this purpose, as shown in the FIG. 5, a force sensor 20 can be provided at the pivot point 6. The force sensor 6 is connected to an input of a processor control 21 which has an output connected to the setting element 11. The force sensor 20 monitors the contact pressure and generates a pressure signal representing the present, passive contact pressure Fn passive to the processor control 21 which compares the value of Fn passive with a stored value of the minimum necessary contact pressure Fn min. In the case of an insufficient value of Fn passive, for example with lower values of friction, an additional contact pressure Fn active is effected by the processor control 21 generating a control signal to the setting element 11 to increase the force applied to the guide arm 7. The effect of this regulating function is illustrated in the diagram of FIG. 6. At a point in time t1, a lowering of the contact pressure Fn passive is reported to the processor control 21 by the force sensor 20, whereupon an additional contact pressure Fn active is immediately produced by the processor output by way of the setting element 11. The additional contact pressure Fn active adds to the still present contact pressure Fn passive to provide a resultant contact pressure Fn res which lies above the minimum necessary contact pressure Fn min. The contact pressure Fn is controllable in all possible situations by this additional equipment and regulation. The sensor 20 also can be utilized at any of the pivot points 6 shown in the FIGS. 1 and 3. Hydraulic cylinders and associated components can, for example, be used as the setting elements 11.

For heavier cars and larger loads, a second drive system in the form of the pulling carriage 15, shown in the FIGS. 3 and 4, can be provided for the purpose of maintaining low contact pressures per friction wheel 9. As shown in the FIG. 3, this second drive system is arranged above the car 1 or above the car frame 1.1 and is mechanically connected therewith by means of the tie rods 16 and the fasteners 17. In the case of unchanging contact pressures, double the weight can be vertically conveyed with this double drive. In accordance with the FIGS. 3 and 4, the friction wheels 9 roll on, for example, the double T-section rails 12 and the safety device 14 engages on the T-rail 13. The lifting carriage 2 and the pulling carriage 15 are respectively provided with the guide elements 14.1 and 15.1, so that the necessary lateral guidance in the Y direction is guaranteed. The use of the double T-section track rails 12 effects an additional improved distribution of the contact pressures on the shaft wall 5.2 because the travel and guide rails form a supporting bridge between the floors in the elevator shaft 5.

The lifting carriage 2 contains a temporary energy store, which is not illustrated, for the purpose of bridging over temporary interruptions in the electrical energy supply and as an energy source, independent of the electrical mains, for horizontal travels between elevator shafts. The energy store is held at full charge during mains operation. For vertical travels, however, the electrical energy is permanently obtained from the mains by slip conductors which are not illustrated. High-speed regulated direct current or alternating current electric motors are provided as the drive motors 8, and compact epicyclic gears or combined epicyclic/bevel gears are advantageously used as reduction and transmission gears for the purpose of optimal efficiency. The car 1 furthermore possesses an autonomous control for the administration of the car calls or destination calls, wherein the distance to a another car possibly disposed above or below is continuously recorded by wire-free distance measuring. Moreover, calls activated at the floors are transmitted wire-free to the cars by suitable means.

Conventional binary coded magnetically or optically sensed code strips, for example disposed at a shaft wall, are used to generate shaft data. In the case of the embodiments according to the FIGS. 1, 2 and 5, the shaft 5 is, for the reception of the contact pressures by the friction wheels 9, formed as a reinforced concrete construction or in a modular steel skeleton manner of construction with appropriate load capacity for withstanding the horizontal forces.

The safety device 14 (FIG. 3) according to regulations is provided on the lifting carriage 2 as security against dropping in the case of wheel breakage or in the case of excess speed. A speed limiter, which is not illustrated and which is disposed on the car and driven by a guide roller or a friction wheel, effects triggering of the safety device 14 in the case of an emergency.

Following the law of physics that action is equal to reaction, the friction wheel drive on one side of the car can be rigidly connected with the lifting or pulling carriage chassis. As shown in the FIG. 5, the setting element 11 at the right side can be replaced by the rigid strut 18 adjustable in length by means of the threaded adjusting nut 19. This construction has the advantage that the required angle p is optimally adjusted on the side of the movably arranged friction wheel drives and can be changed if the need arises.

In a still further developed form, the friction wheel drive can be fastened on one side without the guides 7 on a fixed, non-adjustable support at the underside of the lifting carriage 2. Then the function of the passive and active pressing-on of the friction wheels 9 must the be carded out on the opposite side of the car 1.

The setting elements 11 can also be provided as spindle drive elements, combined with a spring part. A further possibility consists in constructing the setting elements as pneumatic drive elements.

A direct drive without a gear can also be provided as the friction wheel drive, wherein a compact, space-saving motor/friction-wheel can be used. In such a solution, the motor rotor is a stationary axle and the motor stator a component of the friction wheel. For lower speeds, however, the combination with an epicyclic gear within the friction wheel body is also possible.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A self-propelled elevator car for vertical travel in a shaft includes a vertically acting friction wheel drive having friction wheels which project laterally beyond the sides of the car and are pressed in an approximately horizontal direction against an associated running surface on a wall of the shaft by a force applying device, the force applying device comprising:

a carriage attached to an elevator car which car travels in a shaft and exerts a load-dependent passive gravitational force on said carriage; and a guide arm having one end pivotally attached to said carriage and extending downwardly and outwardly to an opposite free end, said opposite free end being connected to a friction wheel for applying the load-dependent passive gravitational force as a passive contact pressure pressing the friction wheel against a wall of the shaft, said opposite free end being positioned closer to the wall of the shaft than said one end, said guide arm extending at a predetermined angle between a horizontal axis of the car and a straight line extending from a point at which said one end of said guide arm is pivotally mounted to a point of contact between the friction wheel and the wall of the shaft, said predetermined angle being selected to apply said passive contact pressure at a magnitude (Fn passive) sufficient to exceed a minimum necessary contact pressure magnitude (Fn min) during at least a portion of an operation of the elevator car in the elevator shaft.

2. The self-propelled elevator car according to claim 1 including a setting element connected between said carriage and said guide arm for applying an active contact pressure to said guide arm pressing the friction wheel against the wall of the shaft.

3. The self-propelled elevator car according to claim 2 wherein said setting element is regulable for increasing and decreasing the applied active contact pressure during operation of the elevator car.

4. The self-propelled elevator car according to claim 1 wherein said predetermined angle is approximately 20° with respect to a horizontal direction transverse to the direction of travel of the car.

5. The self-propelled elevator car according to claim 1 including a stay connected between said carriage and said guide arm and a means for adjusting a length of said stay.

6. The self-propelled elevator car according to claim 5 wherein said means for adjusting is a sleeve nut attached to said stay.

7. The self-propelled elevator car according to claim 1 including an adjustable compression spring connected to said guide arm by a pushrod for forcing said guide arm toward the wall of the shaft.

8. The self-propelled elevator car according to claim 1 including a force sensor mounted at said one end of said guide arm for generating a pressure signal representing the passive contact pressure pressing the friction wheel against the wall of the shaft, a setting element connected between said carriage and said guide arm for applying an active contact pressure to said guide arm pressing the friction wheel against the wall of the shaft, and a processor control having an input connected to said force sensor and an output connected to said setting element and being responsive to a predetermined value of said pressure signal for generating a control signal to said setting element for applying the active contact pressure.

9. A force applying device for a friction wheel drive of a self-propelled elevator car for travel in an elevator shaft, the friction wheel drive having wheels projecting laterally beyond sides of the car and being pressed into engagement with associated running surfaces on walls of the shaft by the force applying device, the force applying device comprising:

a guide arm connected to an elevator car which car travels in a shaft and exerts a load-dependent passive gravitational force on said guide arm, one end of said guide arm being pivotally mounted and extending downwardly and outwardly to an opposite free end, said opposite free end being connected to a friction wheel for applying the load-dependent passive gravitational force as a passive contact pressure pressing the friction wheel against a wall of the shaft, said opposite free end being positioned closer to the wall of the shaft than said one end; and means for selectively maintaining a predetermined angle between a horizontal axis of the car and a straight line extending from a point at which said one end of said guide arm is pivotally mounted to a point of contact between the friction wheel and the wall of the shaft, said predetermined angle being selected to apply said passive contact pressure at a magnitude (Fn passive) sufficient to exceed a minimum necessary contact pressure magnitude (Fn rain) during at least a portion of an operation of the elevator car in the elevator shaft.

10. The force applying device according to claim 9 wherein said means for selectively maintaining includes a setting element connected between the car and said guide arm for applying an active contact pressure to said guide arm pressing the friction wheel against the wall of the shaft.

11. The force applying device according to claim 9 wherein said means for selectively maintaining includes a stay connected between said carriage and said guide arm and a sleeve nut attached to said stay for adjusting a length of said stay.

12. The force applying device according to claim 9 wherein said means for selectively maintaining includes an adjustable compression spring connected to said guide arm by a pushrod for forcing said guide arm toward the wall of the shaft.

13. A self-propelled elevator car for vertical travel in a shaft includes a vertically acting friction wheel drive having friction wheels which project laterally beyond the sides of the car and are pressed in an approximately horizontal direction against an associated running surface on a wall of the shaft by a force applying device, the force applying device comprising:

a carriage attached to an elevator car which car travels in a shaft and exerts a load-dependent passive gravitational force on said carriage;

a plurality of guide arms each having one end pivotally attached to said carriage and extending downwardly and outwardly to an opposite free end, each said opposite free end being connected to an associated friction wheel for applying the load-dependent passive gravitational force as a passive contact pressure pressing the associated friction wheel against a wall of the shaft; and a setting element connected between said carriage and at least one of said guide arms for applying an active contact pressure to said one guide arm pressing the associated friction wheel against the wall of the shaft.

14. The self-propelled elevator car according to claim 13 wherein said setting element is regulable for increasing and decreasing the applied active contact pressure during operation of the elevator car.

15. The self-propelled elevator car according to claim 14 including a force sensor mounted at said one end of said one guide arm for generating a pressure signal representing the passive contact pressure pressing the associated friction wheel against the wall of the shaft and a processor control having an input connected to said force sensor and an output connected to said setting element and being responsive to a predetermined value of said pressure signal for generating a control signal to said setting element for applying the active contact pressure.

16. The self-propelled elevator car according to claim 13 wherein said guide arms are positioned at a predetermined angle with respect to a horizontal direction transverse to the direction of travel of the car.

17. The self-propelled elevator car according to claim 13 including a stay connected between said carriage and another one of said guide arms and a means for adjusting a length of said stay.

18. The self-propelled elevator car according to claim 17 wherein said means for adjusting is a sleeve nut attached to said stay.

19. The self-propelled elevator car according to claim 13 including an adjustable compression spring connected between said one guide arm and another one of said guide arms by pushrods for forcing said guide arms toward the wall of the shaft.

* * * * *